US011741883B2

(12) United States Patent
Liu et al.

(10) Patent No.: US 11,741,883 B2
(45) Date of Patent: Aug. 29, 2023

(54) PIXEL CIRCUIT, CONTROL METHOD THEREOF AND DISPLAY PANEL

(71) Applicant: BOE Technology Group Co., Ltd., Beijing (CN)

(72) Inventors: Dongni Liu, Beijing (CN); Minghua Xuan, Beijing (CN); Li Xiao, Beijing (CN); Liang Chen, Beijing (CN); Hao Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 406 days.

(21) Appl. No.: 16/982,062

(22) PCT Filed: Apr. 27, 2020

(86) PCT No.: PCT/CN2020/087177
§ 371 (c)(1),
(2) Date: Sep. 18, 2020

(87) PCT Pub. No.: WO2020/233355
PCT Pub. Date: Nov. 26, 2020

(65) Prior Publication Data

US 2022/0383799 A1 Dec. 1, 2022

(30) Foreign Application Priority Data

May 17, 2019 (CN) ..... 201910410993.2

(51) Int. Cl.
*G09G 3/32* (2016.01)

(52) U.S. Cl.
CPC ..... *G09G 3/32* (2013.01); *G09G 2300/0819* (2013.01); *G09G 2300/0852* (2013.01);
(Continued)

(58) Field of Classification Search
CPC ..... G09G 3/20; G09G 2300/0871; G09G 2310/027; G09G 2310/0291;
(Continued)

(56) References Cited

U.S. PATENT DOCUMENTS

2015/0108437 A1 4/2015 Cho et al.
2015/0138171 A1 5/2015 Kim et al.
(Continued)

FOREIGN PATENT DOCUMENTS

CN 101000739 A 7/2007
CN 104167181 A 11/2014
(Continued)

OTHER PUBLICATIONS

Office Action dated Aug. 10, 2021 for Chinese Patent Application No. 201910410993.2 and English Translation.
(Continued)

*Primary Examiner* — Andrew Sasinowski
(74) *Attorney, Agent, or Firm* — Ling Wu; Stephen Yang; Ling and Yang Intellectual Property

(57) ABSTRACT

The present disclosure proposes a pixel circuit, a control method thereof and a display panel. The pixel circuit includes a first light-emitting element, a pixel drive circuit connected with the first light-emitting element, a repair branch circuit connected with a node between the pixel drive circuit and the first light-emitting element, wherein the repair branch circuit includes a switch circuit and a second light-emitting element connected in series, and the switch circuit controls a connection or disconnection of the second light-emitting element with the pixel drive circuit; a control circuit connected with a control terminal of the switch circuit, a first data terminal and a first control terminal, the control circuit is configured to write a signal of the first data terminal to the control terminal of the switch circuit under a
(Continued)

control of the first control terminal to control on or off of the switch circuit.

8 Claims, 7 Drawing Sheets

(52) U.S. Cl.
CPC ... *G09G 2310/08* (2013.01); *G09G 2330/021* (2013.01); *G09G 2330/08* (2013.01)

(58) Field of Classification Search
CPC ..... G09G 3/3688; G09G 2320/0233; G09G 2310/0289; G09G 2320/0223; G09G 3/3275; G09G 3/3685
See application file for complete search history.

(56) References Cited

U.S. PATENT DOCUMENTS

| | | | | |
|---|---|---|---|---|
| 2015/0339975 | A1* | 11/2015 | Liu ..... | G09G 3/3233 345/204 |
| 2015/0364531 | A1 | 12/2015 | Kim et al. | |
| 2017/0039934 | A1 | 2/2017 | Ma | |
| 2017/0316737 | A1 | 11/2017 | Park | |
| 2019/0096327 | A1 | 3/2019 | Peng et al. | |
| 2020/0074929 | A1 | 3/2020 | Chen et al. | |

FOREIGN PATENT DOCUMENTS

| | | | |
|---|---|---|---|
| CN | 104576686 | A | 4/2015 |
| CN | 104659058 | A | 5/2015 |
| CN | 104732926 | A | 6/2015 |
| CN | 105225639 | A | 1/2016 |
| CN | 205541823 | U | 8/2016 |
| CN | 106991967 | A | 7/2017 |
| CN | 107564462 | A | 1/2018 |
| CN | 107610652 | A | 1/2018 |
| CN | 108717841 | A | 10/2018 |
| CN | 110047425 | A | 7/2019 |
| EP | 2955709 | A1 | 12/2015 |
| EP | 3093836 | A1 | 11/2016 |
| EP | 3633660 | A1 | 4/2020 |
| KR | 10-2015-0093909 | A | 8/2015 |
| KR | 10-2017-0049283 | A | 5/2017 |

OTHER PUBLICATIONS

Office Action dated Apr. 16, 2020 for Chinese Patent Application No. 201910410993.2 and English Translation.
International Search Report for PCT/CN2020/087177 dated Jul. 29, 2020.
Office Action dated Oct. 14, 2020 for Chinese Patent Application No. 201910410993.2 and English Translation.
Office Action dated Jan. 8, 2021 for Chinese Patent Application No. 201910410993.2 and English Translation.

* cited by examiner

PIXEL CIRCUIT, CONTROL METHOD THEREOF AND DISPLAY PANEL

CROSS-REFERENCE TO RELATED APPLICATION

The present application claims the priority to Chinese patent application No. 201910410993.2, filed to CNIPA on May 17, 2019, entitled "pixel circuit, control method thereof and display panel", the entire content of which is incorporated in the present application by reference.

TECHNICAL FIELD

The present application relates to the technical field of display, in particular to a pixel circuit, a control method thereof and a display panel.

BACKGROUND

Light-emitting diodes, such as a MicroLED and a MiniLED, are widely used in a future display field because of their high brightness and high reliability. After being fabricated on a Wafer, the MicroLED or MiniLED is welded on a backing plate (BP) (a main board bearing a sub-board or line card) by transfer printing. The BP provides a current drive circuit, and the current flows through the MicroLED or MiniLED to make the LED emit light and achieve display function.

SUMMARY

The present disclosure is intended to solve one of technical problems in the related art at least to some extent.

Thus, a first objective of the present disclosure is to propose a pixel circuit to achieve a light-emitting repair function and improve a yield of display panel.

A second objective of the present disclosure is to propose a control method of the pixel circuit.

In order to achieve the above objectives, an embodiment of the present disclosure proposes a pixel circuit. The pixel circuit includes: a first light-emitting element, a pixel drive circuit which is connected with the first light-emitting element, a repair branch circuit which is connected with a node between the pixel drive circuit and the first light-emitting element, wherein the repair branch circuit includes a switch circuit and a second light-emitting element connected in series, and the switch circuit controls a connection or disconnection of the second light-emitting element with the pixel drive circuit; a control circuit which is connected with a control terminal of the switch circuit, a first data terminal and a first control terminal, wherein the control circuit is configured to write a signal of the first data terminal to the control terminal of the switch circuit under a control of the first control terminal to control on or off of the switch circuit.

According to the pixel circuit proposed by the embodiment of the present disclosure, when the first light-emitting element is in a normal state, the switch circuit is off under a control of the control circuit to control the second light-emitting element to be disconnected from the pixel drive circuit, and the pixel drive circuit drives the first light-emitting element to emit light. When the first light-emitting element is in a abnormal state, the switch circuit is on under a control of the control circuit to control the second light-emitting element to be connected with the pixel drive circuit, and the pixel drive circuit drives the second light-emitting element to emit light. Therefore, the pixel circuit of the embodiment of the disclosure can achieve a light-emitting repair function and improve a yield of display panel by means of the repair branch circuit and the control circuit, and a connection of the second light-emitting element and the first light-emitting element in parallel.

According to an embodiment of the present disclosure, the switch circuit includes a first transistor, a first electrode of which is connected with a node between the pixel drive circuit and the first light-emitting element, a second electrode of which is connected with the second light-emitting element, and a gate electrode of which is connected with the control circuit.

According to an embodiment of the present disclosure, the control circuit includes a second transistor, a first electrode of which is connected with the first data terminal, a second electrode of which is connected with the control terminal of the switch circuit, and a gate electrode of which is connected with the first control terminal.

According to an embodiment of the present disclosure, the control circuit further includes a first capacitor, one terminal of which is connected with both the second electrode of the second transistor and the control terminal of the switch circuit, and the other terminal of which is connected with a preset power supply.

According to an embodiment of the present disclosure, both the first light-emitting element and the second light-emitting element are light-emitting diodes.

According to an embodiment of the present disclosure, the pixel drive circuit includes a drive transistor, a first electrode of which is connected with the preset power supply, and a second electrode of which is connected with the first light-emitting element and the repair element; a third transistor, a first electrode of which is connected with a second data terminal, a second electrode of which is connected with a gate electrode of the drive transistor, and a gate electrode of which is connected with the first control terminal; a second capacitor, one terminal of which is connected with the gate electrode of the drive transistor, and the other terminal of which is connected with the first electrode of the drive transistor.

According to an embodiment of the present disclosure, the pixel drive circuit further includes a fourth transistor, a first electrode of which is connected with an initialization terminal, a second electrode of which is connected with the gate electrode of the drive transistor, and a gate electrode of which is connected with a reset terminal; a fifth transistor, a first electrode of which is connected with the initialization terminal, a second electrode of which is connected with the first light-emitting element, and a gate electrode of which is connected with the reset terminal; a sixth transistor, a first electrode of which is connected with the gate electrode of the drive transistor, a second electrode of which is connected with the second electrode of the drive transistor, and a gate electrode of which is connected with the first control terminal; a seventh transistor, the seventh transistor is located between and connected with the first electrode of the drive transistor and the preset power supply, a gate electrode of which is connected with a second control terminal; an eighth transistor, the eight transistor is located between and connected with the second electrode of the drive transistor and the first light-emitting element, a gate electrode of the eighth transistor is connected with the second control terminal.

In order to achieve the above objects, another embodiment of the present disclosure proposes a control method of the pixel circuit, which includes: determining a state of the first light-emitting element; when the first light-emitting element is in a normal state, controlling the switch circuit to be off to control the second light-emitting element to be disconnected from the pixel drive circuit, wherein the pixel drive circuit drives the first light-emitting element to emit light; when the first light-emitting element is in an abnormal state, controlling the switch circuit to be on to control the second light-emitting element to be connected with the pixel drive circuit, wherein the pixel drive circuit drives the second light-emitting element to emit light.

According to the control method of the pixel circuit provided by the embodiment of the present disclosure, when the first light-emitting element is determined to be in a normal state, the switch circuit is controlled to be off to control the second light-emitting element to be disconnected from the pixel drive circuit, and the pixel drive circuit drives the first light-emitting element to emit light. When the first light-emitting element is in an abnormal state, the switch circuit is controlled to be on to control the second light-emitting element to be connected with the pixel drive circuit, and the pixel drive circuit drives the second light-emitting element to emit light. Therefore, according to the control method of the pixel circuit of the embodiment of the present disclosure, a light-emitting repair function can be achieved, and a yield of display panel can be improved by means of the switch circuit and the second light-emitting element, and a connection of the second light-emitting element and the first light-emitting element in parallel.

According to an embodiment of the present disclosure, controlling the switch circuit to be on or off includes that the control circuit writes a signal of the first data terminal into the control terminal of the switch circuit to control the switch circuit to be on or off under a control of the first control terminal.

Additional aspects and advantages of the present disclosure will be set forth in part in the following description, and part of which will be apparent from the description, or may be learned through practice of the present disclosure.

BRIEF DESCRIPTION OF DRAWINGS

The above and/or additional aspects and advantages of the present disclosure will become apparent and easily understood from the following description of embodiments with reference to the accompanying drawings, in which.

DETAILED DESCRIPTION

Figure 1:
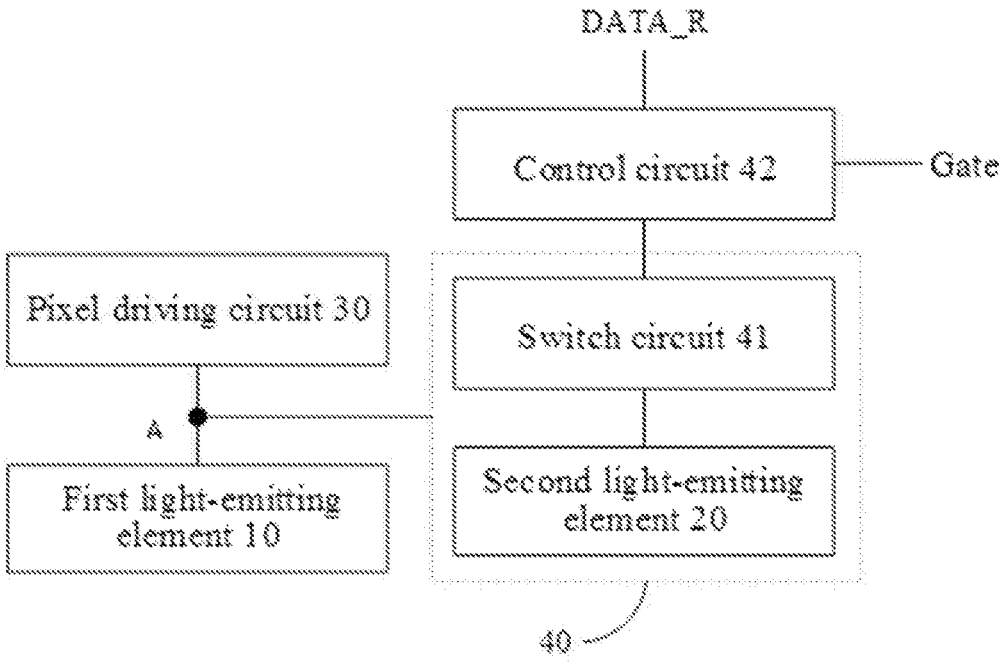
FIG. 1 is a schematic block diagram of a pixel circuit according to an embodiment of the present disclosure.

Descriptions will now be made in detail to embodiments of the present disclosure, examples of which are illustrated in the accompanying drawings. The same or similar elements and the elements having same or similar functions are denoted by the same or similar reference numerals throughout the descriptions. The embodiments described below with reference to the drawings are illustrative, and are merely intended to explain the present disclosure, which cannot be interpreted as a limitation of the present disclosure.

Before describing a pixel circuit, a control method thereof and a display panel according to an embodiment of the present disclosure with reference to the drawings, a pixel circuit in the related art will be briefly introduced.

Figure 9:
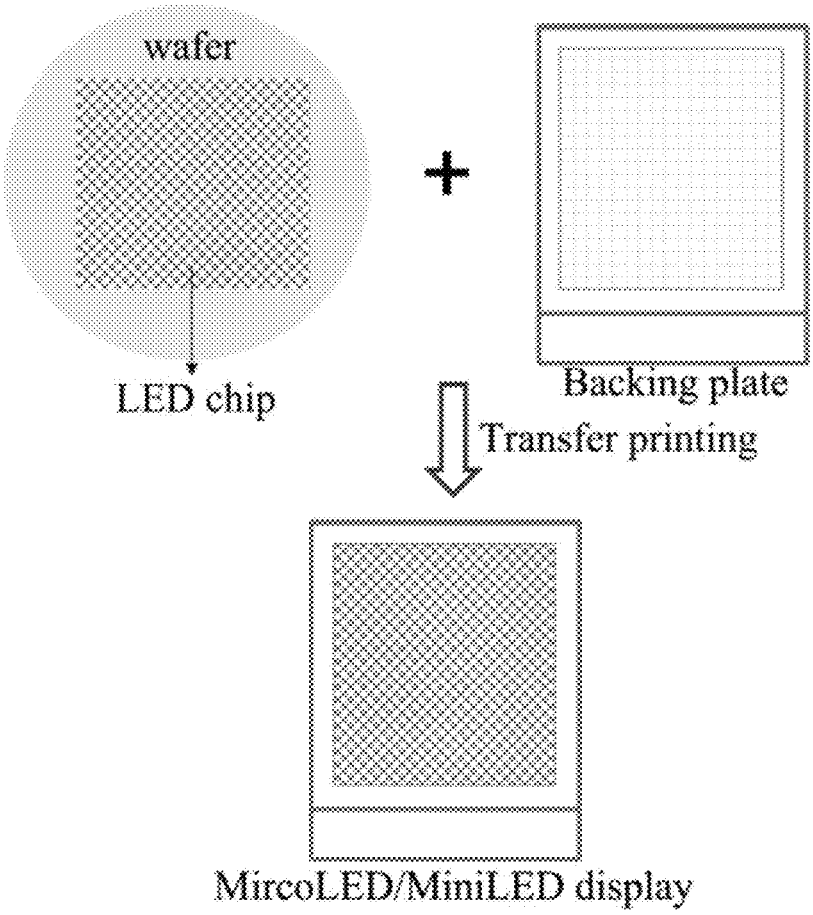
FIG. 9 is a schematic diagram of structure of a display panel according to an embodiment of the present disclosure.

Light-emitting diodes, such as a MicroLED and MiniLED, are widely used in a future display field because of their high brightness and high reliability. As shown in FIG. 9, after being fabricated on Wafer, the MicroLED or MiniLED is welded on a backing plate (BP) (a main board bearing a sub-board or line card) by transfer printing, and the BP provides a current drive circuit, in which the MicroLED or MiniLED is welded on cathode and anode electrodes of a pixel, and a current flows through the MicroLED or MiniLED to make the LED emit light and achieve a display function.

In the related art, one pixel circuit may correspond to one light-emitting element. However, there is a problem in the pixel circuit in the related art that a large number of MicroLEDs or MiniLEDs are transferred to meet display requirements of high resolution and high PPI (Pixels Per Inch). Taking a FHD (Full High Definition) as an example, one sub-pixel corresponds to one light-emitting element, that is, one LED chip. To achieve a display, 6.2208 million LED chips need to be transferred, and a transfer failure or LED chip damage will lead to a poor display of a dark point. Even if a yield of transfer is high, the problem of poor dark point is still very serious due to a great number of chips to be transferred.

In view of this, the present disclosure provides a pixel circuit, a control method thereof and a display panel.

The pixel circuit, the control method thereof and the display panel according to embodiments of the present disclosure will be described below with reference to the drawings.

FIG. 1 is a schematic block diagram of a pixel circuit according to an embodiment of the present disclosure.

As shown in FIG. 1, the pixel circuit of the embodiment of the present disclosure includes a first light-emitting element 10, a pixel drive circuit 30, a repair branch circuit 40 and a control circuit 42.

The pixel drive circuit 30 is connected with the first light-emitting element 10. The repair branch circuit 40 is connected with a node A between the pixel drive circuit 30 and the first light-emitting element 10, wherein the repair branch circuit 40 includes a switch circuit 41 and a second light-emitting element 20 connected in series, and the switch circuit 41 controls a connection or disconnection of the second light-emitting element 20 with the pixel drive circuit 30. The control circuit 42 is connected with a control terminal of the switch circuit 41, a first data terminal DATA_R and a first control terminal Gate. The control circuit 42 is used to, under a control of the first control terminal (Gate), write a signal of the first data terminal DATA_R into the control terminal of the switch circuit 41 to control on or off of the switch circuit 41.

According to an embodiment of the present disclosure, both of the first light-emitting element 10 and the second light-emitting element 20 may be light-emitting diodes, specifically MicroLEDs or MiniLEDs, wherein the first light-emitting element 10 may be a first light-emitting diode LED1 and the second light-emitting element 20 may be a second light-emitting diode LED2.

Figure 8:
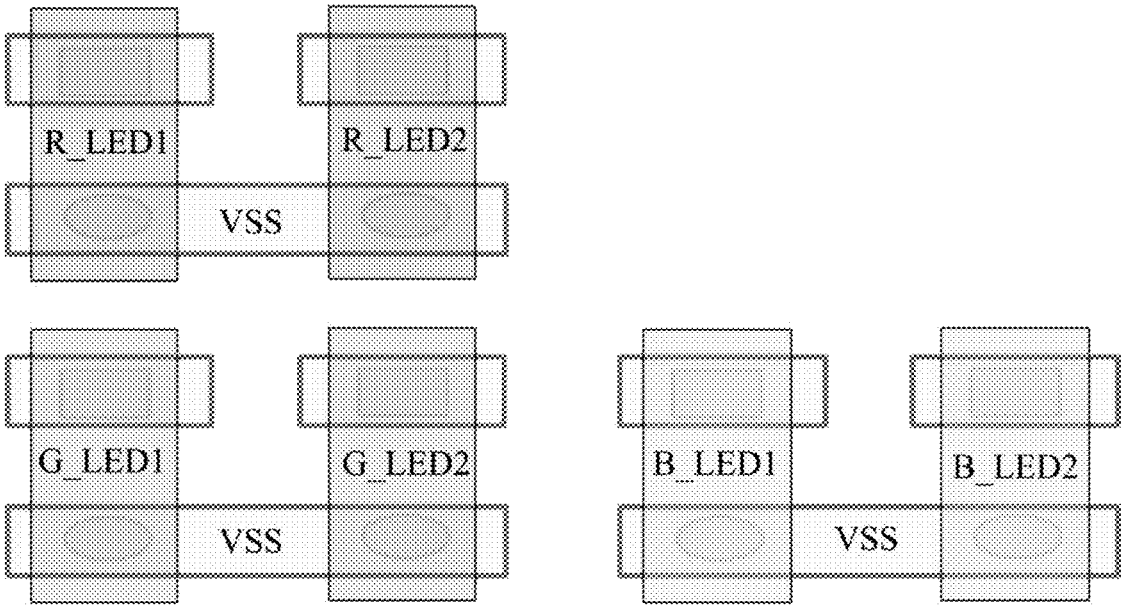
FIG. 8 is a schematic diagram of an arrangement of light-emitting elements in a pixel circuit according to an embodiment of the present disclosure.

Furthermore, the second light-emitting element 20 and the first light-emitting element 10 may be designed in parallel, that is, as shown in FIG. 8, three primary colors R, G and B may transfer two parallel light-emitting diodes respectively. For example, the primary color R may transfer two parallel light-emitting diodes, i.e., a first light-emitting diode R_LED1 and a second light-emitting diode R_LED2, the primary color G may transfer two parallel light-emitting diodes, i.e., a first light-emitting diode G_LED1 and a second light-emitting diode G_LED2, the primary color B may transfer two parallel light-emitting diodes, i.e., a first light-emitting diode B_LED1 and a second light-emitting diode B_LED2, wherein VSS may be a preset power supply, that is, a cathode of the first light-emitting diode R_LED1 and a cathode of the second light-emitting diode R_LED2, a cathode of the first light-emitting diode G_LED1 and a cathode of the second light-emitting diode G_LED2, a cathode of the first light-emitting diode B_LED1 and a cathode of the second light-emitting diode B_LED2 may be applied with a voltage of the preset power VSS, i.e., a low-level voltage.

It can be understood that when the first light-emitting element 10 is in a normal state, the pixel drive circuit 30 drives the first light-emitting element 10 to emit light, and the switch circuit 41 is off to control the second light-emitting element 20 to be disconnected with the pixel drive circuit 30 under a control of the control circuit 42. When the first light-emitting element 10 is in an abnormal state, the switch circuit 41 is on to control the second light-emitting element 20 to be connected with the pixel drive circuit 30 under a control of the control circuit 42, so that the pixel drive circuit 30 drives the second light-emitting element 20 to emit light. Therefore, in the pixel circuit of the embodiment of the present disclosure, by means of the switch circuit 41, the second light-emitting element 20 and the control circuit 42, and a connection of the first light-emitting element 10 and the second light-emitting element 20 in parallel, a light-emitting repair function can be achieved and a yield of display panel can be improved.

In addition, the repair branch circuit 40 and the control circuit 42 in the pixel circuit according to the embodiment of the present disclosure may further correspond to a plurality of pixel drive circuits 30 and a plurality of first light-emitting elements 10, that is, when one of the first light-emitting elements 10 is in an abnormal state, the light-emitting repair function can be achieved through the repair branch circuit 40 and the control circuit 42.

Specifically, the nodes A between the plurality of pixel drive circuits 30 and their corresponding first light-emitting elements 10 are connected to the repair branch circuit 40.

A structure and principle of the pixel circuit according to an embodiment of the present disclosure will be described below with reference to FIGS. 2, 3 and 4.

Figure 2:
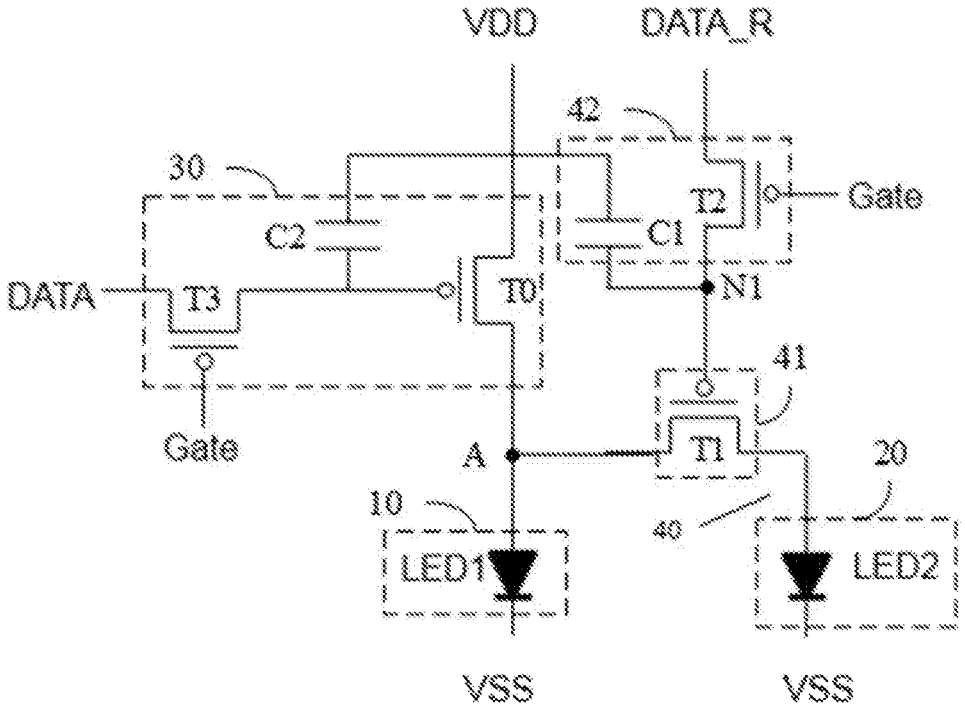
FIG. 2 is a schematic circuit diagram of a pixel circuit according to an embodiment of the present disclosure.

According to an embodiment of the present disclosure, as shown in FIG. 2, the switch circuit 41 includes a first transistor T1. Herein, a first electrode of the first transistor T1 is connected with a node A between the pixel drive circuit 30 and the first light-emitting element 10, a second electrode of the first transistor T1 is connected with the second light-emitting element 20, and a gate of the first transistor T1 is connected with the control circuit 42.

According to an embodiment of the present disclosure, as shown in FIG. 2, the control circuit 42 includes a second transistor T2. Herein, a first electrode of the second transistor T2 is connected with the first data terminal DATA_R, a second electrode of the second transistor T2 is connected with the control terminal of the switch circuit 41, and a gate electrode of the second transistor T2 is connected with the first control terminal (Gate).

According to an embodiment of the present disclosure, as shown in FIG. 2, the control circuit 42 further includes a first capacitor C1. Herein, one terminal of the first capacitor C1 is connected with both of the second electrode of the second transistor T2 and the control terminal of the switch circuit 41, and the other terminal of the first capacitor C1 is connected with a preset power supply VDD.

According to an embodiment of the present disclosure, as shown in FIG. 2, the pixel drive circuit 30 includes a drive transistor T0, a third transistor T3 and a second capacitor C2. Herein, a first electrode of the drive transistor T0 is connected with the preset power supply VDD, and a second electrode of the drive transistor T0 is connected with the first light-emitting element 10 and the repair element 40; a first electrode of the third transistor T3 is connected with a second data terminal DATA, a second electrode of the third transistor T3 is connected with a gate electrode of the drive transistor T0, and a gate electrode of the third transistor T3 is connected with the first control terminal (Gate); one terminal of the second capacitor C2 is connected with the gate electrode of the drive transistor T0, and the other terminal of the second capacitor C2 is connected with the first electrode of the drive transistor T0.

It should be noted that the first transistor T1, the second transistor T2, the third transistor T3 and the drive transistor T0 may be PMOS transistors.

Referring to timing diagrams of FIGS. 3 and 4, an operational principle of the embodiment of FIG. 2 is as follows.

Figure 3:
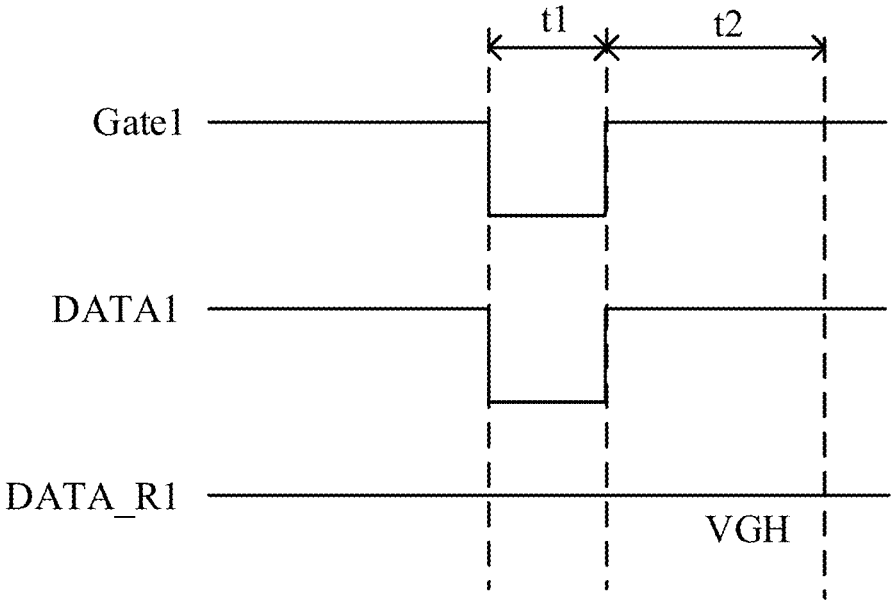
FIG. 3 is a timing diagram of a pixel circuit according to an embodiment of the present disclosure.
Figure 4:
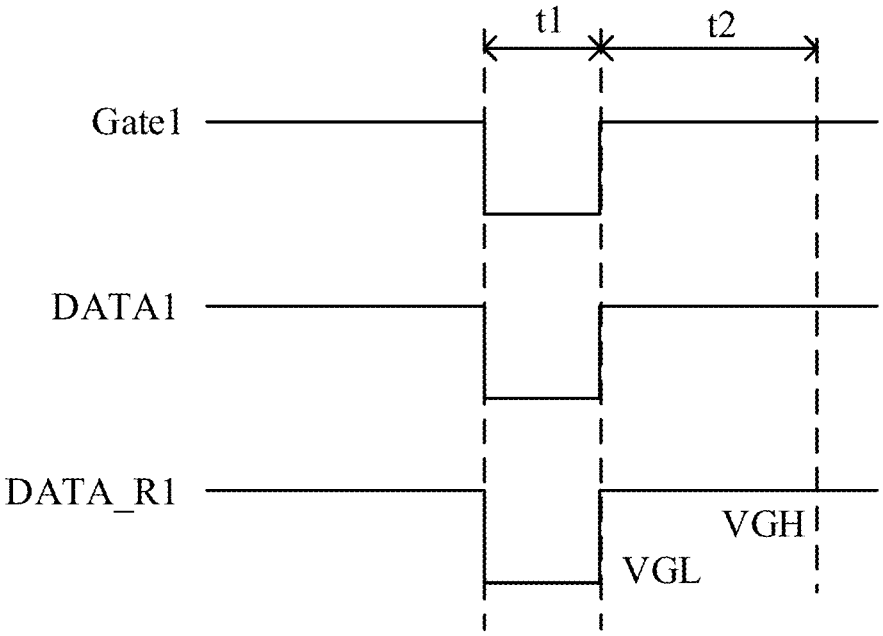
FIG. 4 is a timing diagram of a pixel circuit according to another embodiment of the present disclosure.

FIG. 3 is a timing diagram when the first light-emitting element 10 is in a normal state, and FIG. 4 is a timing diagram when the first light-emitting element 10 is in an abnormal state. Gate1 may be an input signal of the first control terminal (Gate), DATA1 may be an input signal of the second data terminal DATA, and DATA_R1 may be an input signal of the first data terminal DATA_R.

As shown in FIG. 3, when the first light-emitting element 10 is in the normal state:

In a first phase t1: a first control signal, i.e., a low-level signal, is input from the first control terminal (Gate), and both the second transistor T2 and the third transistor T3 are turned on. A high-level signal input from the first data terminal DATA_R is written to N1, i.e., the gate electrode of the first transistor T1, through the second transistor T2, and held by the first capacitor C1. A low-level signal input from the second data terminal DATA is written to the gate electrode of the drive transistor T0 through the third transistor T3, and held by the second capacitor C2.

In a second phase t2: a high-level signal is input from the first control terminal (Gate), a high-level signal is input from the second data terminal DATA, and a high-level signal is input from the first data terminal DATA_R to prepare for a next row scanning. At this time, the third transistor T3 and the second transistor T2 are both turned off under a control of the high-level signal input from the first control terminal (Gate), and a point N1, i.e., the gate pole of the first transistor T1 remains at the high level through an action of the first capacitor C1, the first transistor T1 is turned off, so that no current flows through the second light-emitting element 20, i.e., the second light-emitting diode LED2, which does not emit light. The gate pole of the drive transistor T0 remains at the low level under an action of the second capacitor C2, and the drive transistor T0 is turned on, so that a voltage of the preset power supply VDD, i.e., a high-level voltage, is written to the first light-emitting element 10, specifically, an anode of the first light-emitting diode LED1, through the drive transistor T0. And the cathode of the first light-emitting diode LED1 is applied with the voltage of the preset power VSS, i.e., the low-level voltage, so that a current is generated to flow through the first light-emitting diode LED1 to drive the first light-emitting diode LED1 to emit light.

As shown in FIG. 4, when the first light-emitting element 10 is in the abnormal state:

In a first phase t1: a first control signal, i.e., a low-level signal, is input from the first control terminal (Gate), and both the second transistor T2 and the third transistor T3 are turned on. A low-level signal input from the first data terminal DATA_R is written through the second transistor T2 to the point N1, i.e., the gate electrode of the first transistor T1, and held by the first capacitor C1. A low-level signal input from the second data terminal DATA is written to the gate electrode of the drive transistor T0 through the third transistor T3 and held by the second capacitor C2.

In a second phase t2: a high-level signal is input from the first control terminal (Gate), a high-level signal is input from the second data terminal DATA, and a high-level signal is input from the first data terminal DATA_R to prepare for a next row scanning. At this time, both the third transistor T3 and the second transistor T2 are turned off under a control of the high-level signal input from the first control terminal (Gate), and the point N1, i.e., the gate electrode of the first transistor T1 remains at the low level through an action of the first capacitor C1. The first transistor T1 is turned on, the gate electrode of the drive transistor T0 still remains at the low level through an action of the second capacitor C2, and the drive transistor T0 is turned on, so that the voltage of the preset power supply VDD, i.e., the high-level voltage, is written to the second light-emitting element 20, specifically an anode of the second light-emitting diode LED2, through the drive transistor T0 and the first transistor T1, and the cathode of the second light-emitting diode LED2 is applied with the voltage of the preset power supply VSS, i.e., the low-level voltage, so that a current is generated and flows through the second light-emitting diode LED2 to drive the second light-emitting diode LED2 to emit light.

Therefore, by means of the switch circuit 41, the control circuit 42 and the second light-emitting element 20, and a design of the second light-emitting element 20 and the first light-emitting element 10 in parallel, when the first light-emitting element 10 is in an abnormal state, for example, the first light-emitting diode LED1 is damaged or fails in transfer, a repair function of the first light-emitting element 10 can be achieved by the second light-emitting element 20 designed in parallel, and a yield of display panel can be improved.

A structure and principle of a pixel circuit according to another embodiment of the present disclosure will be described below with reference to FIGS. 5 to 7.

Figure 5:
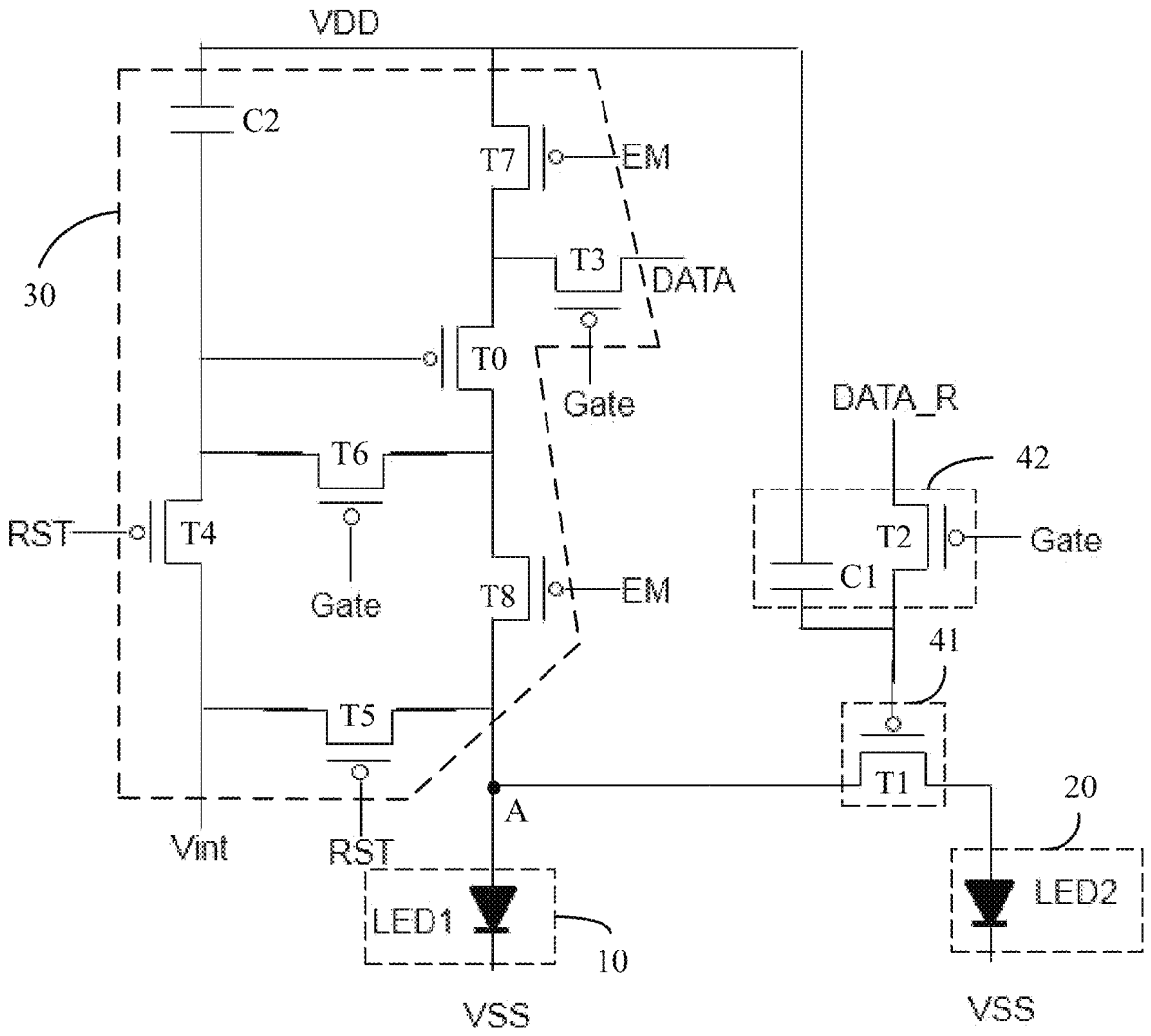
FIG. 5 is a schematic circuit diagram of a pixel circuit according to another embodiment of the present disclosure.

As shown in FIG. 5, according to an embodiment of the present disclosure, the pixel drive circuit 30 includes a drive transistor T0, a third transistor T3 and a second capacitor C2, and further includes a fourth transistor T4, a fifth transistor T5, a sixth transistor T6, a seventh transistor T7 and an eighth transistor T8. As shown in FIG. 5, the pixel drive element 30 further includes a fourth transistor T4, a fifth transistor T5, a sixth transistor T6, a seventh transistor T7 and an eighth transistor T8. A first electrode of the fourth transistor T4 is connected with an initialization terminal Vint, a second electrode of the fourth transistor T4 is connected with the gate electrode of the drive transistor T0, and a gate electrode of the fourth transistor T4 is connected with a reset terminal RST. A first electrode of the fifth transistor T5 is connected with the initialization terminal Vint, a second electrode of the fifth transistor T5 is connected with the first light-emitting element 10, and a gate electrode of the fifth transistor T5 is connected with the reset terminal RST. A first electrode of the sixth transistor T6 is connected with the gate electrode of the drive transistor T0, and a second electrode of the sixth transistor T6 is connected with the second electrode of the drive transistor T0, and a gate electrode of the sixth transistor T6 is connected with the first control terminal (Gate). The seventh transistor T7 is located between and connected with the first electrode of the drive transistor T0 and the preset power supply VDD, and a gate electrode of the seventh transistor T7 is connected with a second control terminal EM. The eighth transistor T8 is located between and connected with the second electrode of the drive transistor T0 and the first light-emitting element 10, and a gate electrode of the eighth transistor T8 is connected with the second control terminal EM.

It should be noted that the first transistor T1, the second transistor T2, the third transistor T3, the fourth transistor T4, the fifth transistor T5, the sixth transistor T6, the seventh transistor T7, the eighth transistor T8 and the drive transistor T0 may be PMOS transistors.

Referring to timing diagrams of FIGS. 6 and 7, an operational principle of an embodiment of FIG. 5 is as follows.

Figure 6:
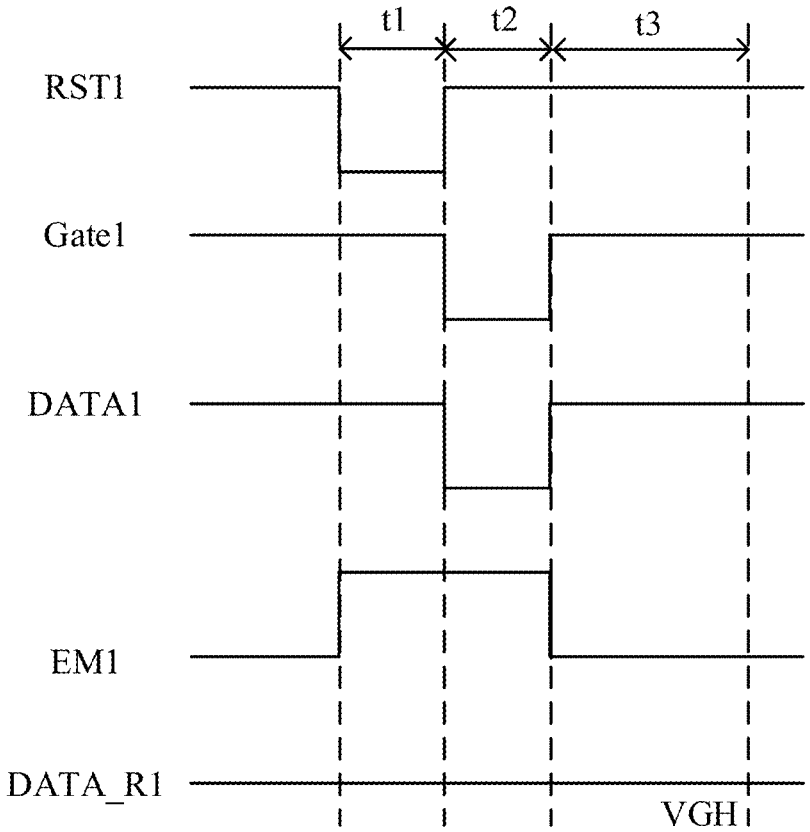
FIG. 6 is a timing diagram of a pixel circuit according to another embodiment of the present disclosure.
Figure 7:
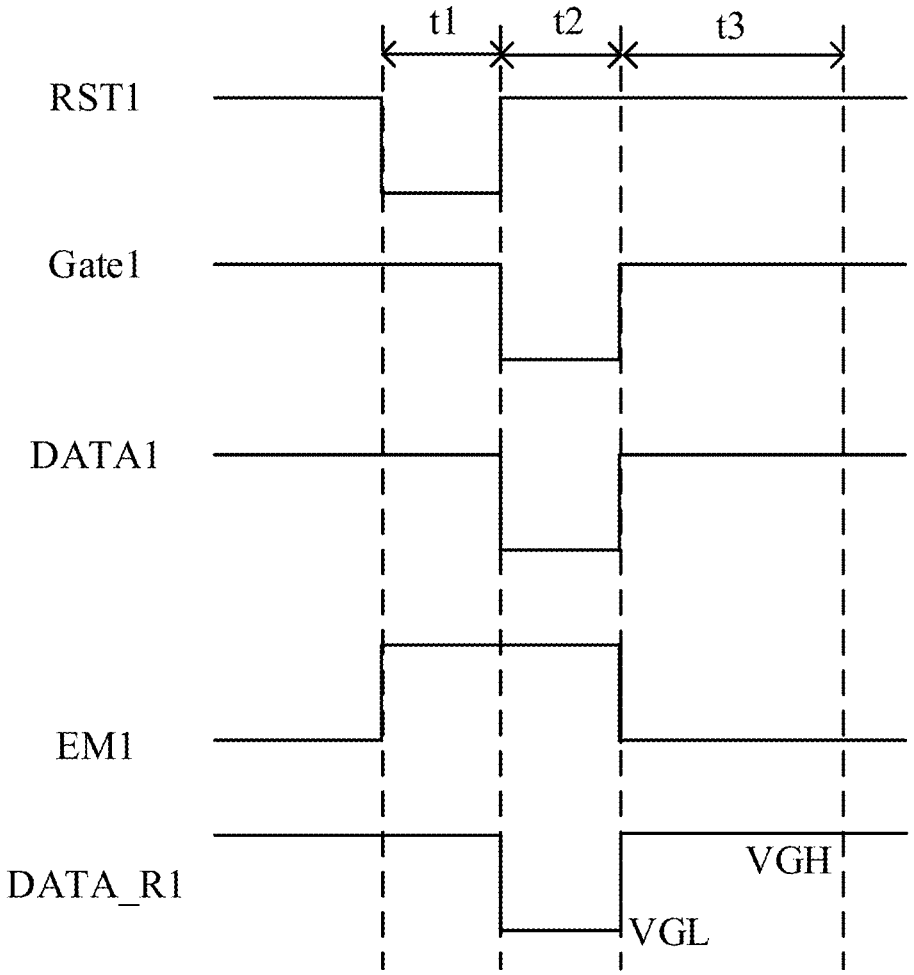
FIG. 7 is a timing diagram of a pixel circuit according to yet another embodiment of the present disclosure.

FIG. 6 is a timing diagram when the first light-emitting element 10 is in a normal state, and FIG. 7 is a timing diagram when the first light-emitting element 10 is in an abnormal state. RST1 may be an input signal of the reset terminal RST, Gate1 may be an input signal of the first control terminal (Gate), DATA1 may be an input signal of the second data terminal DATA, EM1 may be an input signal of the second control terminal EM, and DATA_R1 may be an input signal of the first data terminal DATA_R.

As shown in FIG. 6, when the first light-emitting element 10 is in the normal state:

In a first phase t1: a low-level signal is input from the reset terminal RST, a high-level signal is input from the first control terminal (Gate), a high-level signal is input from the second data terminal DATA, a high-level signal is input from the second control terminal EM, a high-level signal is input from the first data terminal DATA_R, and the fourth transistor T4 and the fifth transistor T5 are turned on, so that a low-level signal input from the initialization terminal Vint is written to the gate electrode of the drive transistor T0 through the fourth transistor T4 to reset the drive transistor T0, and held by the second capacitor C2. At the same time, the low-level signal input from the initialization terminal Vint is written to the first light-emitting element 10, specifically, an anode of the first light-emitting diode LED1 through the fifth transistor T5 to reset the first light-emitting element 10 or the LED1.

In a second phase t2: a high-level signal is input from the reset terminal RST, a first control signal, i.e., a low-level signal is input from the first control terminal (Gate), a low-level signal is input from the second data terminal DATA, a high-level signal is input from the second control terminal EM, a high-level signal is input from the first data terminal DATA_R, the second transistor T2, the third transistor T3 and the sixth transistor T6 are turned on. A voltage Vdata of the low-level signal input from the second data terminal DATA is written to the first electrode of the drive transistor T0 through the third transistor T3, so that the gate voltage of the drive transistor T0 becomes Vdata+Vth, and held by the second capacitor C2. Herein, Vth is a threshold voltage of the drive transistor T0, and the high-level signal input from the first data terminal DATA_R is written to the gate electrode of the first transistor T1 through the second transistor T2 and held by the first capacitor C1.

In a third phase t3: a high-level signal is input from the reset terminal RST, a high-level signal is input from the first data terminal DATA_R, a high-level signal is input from the second data terminal DATA, and a high-level signal is input from the first control terminal (Gate) to prepare for a next row scanning. A low-level signal is input from the second control terminal EM, and the seventh transistor T7 and the eighth transistor T8 are turned on. At the same time, the gate voltage of the drive transistor T0 still remains at Vdata+Vth under an action of the second capacitor C2, the drive transistor T0 is turned on, so that the voltage of the preset power supply VDD, i.e., the high-level voltage, is written to the first light-emitting element 10, specifically, the anode of the first light-emitting diode LED1, through the seventh transistor T7, the drive transistor T0 and the eighth transistor T8, and the cathode of the first light-emitting diode LED1 is applied with the voltage of the preset power supply VSS, i.e., the low-level voltage. Therefore, a current is generated and flows through the first light-emitting diode LED1 to drive the first light-emitting diode LED1 to emit light. At this time, the gate electrode of the first transistor T1 still remains at the high level under an action of the first capacitor C1, and the first transistor T1 is turned off, so that no current flows through the second light-emitting element 20, that is, the second light-emitting diode LED2, thus the second light-emitting diode LED2 does not emit light.

As shown in FIG. 7, when the first light-emitting element 10 is in the abnormal state:

In a first phase t1: a low-level signal is input from the reset terminal RST, a high-level signal is input from the first control terminal (Gate), a high-level signal is input from the second data terminal DATA, a high-level signal is input form the second control terminal EM, a high-level signal is input from the first data terminal DATA_R, and the fourth transistor T4 and the fifth transistor T5 are turned on, so that a low-level signal input by an initialization terminal Vint is written to the gate electrode of the drive transistor T0 through the fourth transistor T4 to reset the drive transistor T0, and held by the second capacitor C2. At the same time, the low level signal input from the initialization terminal Vint is written to the first light-emitting element 10, specifically, the anode of the first light-emitting diode LED1 through the fifth transistor T5 to reset the first light-emitting element 10 or the LED1.

In a second phase t2: a high-level signal is input from the reset terminal RST, a first control signal, i.e., a low-level signal is input from the first control terminal (Gate), a low-level signal is input from the second data terminal DATA, a high-level signal is input from the second control terminal EM, a low-level signal is input from the first data terminal DATA_R, the second transistor T2, the third transistor T3 and the sixth transistor T6 are turned on. A voltage Vdata of the low-level signal input from the second data terminal DATA is written to the first electrode of the drive transistor T0 through the third transistor T3, so that the gate voltage of the drive transistor T0 becomes Vdata+Vth, and held by the second capacitor C2. Herein, Vth is the threshold voltage of the drive transistor T0, and the low-level signal input from the first data terminal DATA_R is written to the gate electrode of the first transistor T1 through the second transistor T2 and held by the first capacitor C1.

In a third phase t3: a high-level signal is input from the reset terminal RST, a high-level signal is input from the first data terminal DATA_R, a high-level signal is input from the second data terminal DATA, and a high-level signal is input from the first control terminal (Gate) to prepare for a next row scanning. A low-level signal is input form the second control terminal EM, the seventh transistor T7 and the eighth transistor T8 are turned on, and at the same time, a gate voltage of the drive transistor T0 still remains at Vdata+Vth under an action of the second capacitor C2, the drive transistor T0 is turned on, the gate electrode of the first transistor T1 still remains at the low level under an action of the first capacitor C1, and the first transistor T1 is turned on, so that the voltage of the preset power supply VDD, i.e., the high-level voltage, is written to the second light-emitting element 20, specifically, an anode of the second light-emitting diode LED2 through the seventh transistor T7, the drive transistor T0, the eighth transistor T8 and the first transistor T1. The voltage of the preset power VSS, i.e., the low-level voltage, is applied to the cathode of the second light-emitting diode LED2, so that a current is generated and flows through the second light-emitting diode LED2 to drive the second light-emitting diode LED2 to emit light.

Therefore, by means of the switch circuit 41, the control circuit 42 and the second light-emitting element 20, and the design of the second light-emitting element 20 and the first light-emitting element 10 in parallel, thereby, when the first light-emitting element 10 is in an abnormal state, for example, the first light-emitting diode LED1 is damaged or fails in transfer, a repair function of the first light-emitting element 10 can be achieved by the second light-emitting element 20 designed in parallel, and a yield of display panel can be improved.

In addition, the pixel circuit of the embodiment of the present disclosure may be applied to a display panel, in particular, to a display panel having a micro light-emitting diode (MicroLED) or a mini light-emitting diode (Mini-LED). To sum up, according to the pixel circuit proposed in the embodiment of the present disclosure, when the first light-emitting element is in a normal state, the pixel drive circuit drives the first light-emitting element to emit light, the switch circuit is off under the control of the control circuit to control the second light-emitting element to be disconnected from the pixel drive circuit. When the first light-emitting element is in an abnormal state, the switch circuit is on under the control of the control circuit to control the second light-emitting element to be connected with the pixel drive circuit. Therefore, the pixel circuit of the embodiment of the present disclosure can achieve the light-emitting repair function and improve the yield of the display panel by means of the repair branch circuit and the control circuit, and the connection of the second light-emitting element and the first light-emitting element in parallel.

Based on the pixel circuit of the above embodiment, an embodiment of the present disclosure further proposes a control method of a pixel circuit.

Figure 10:
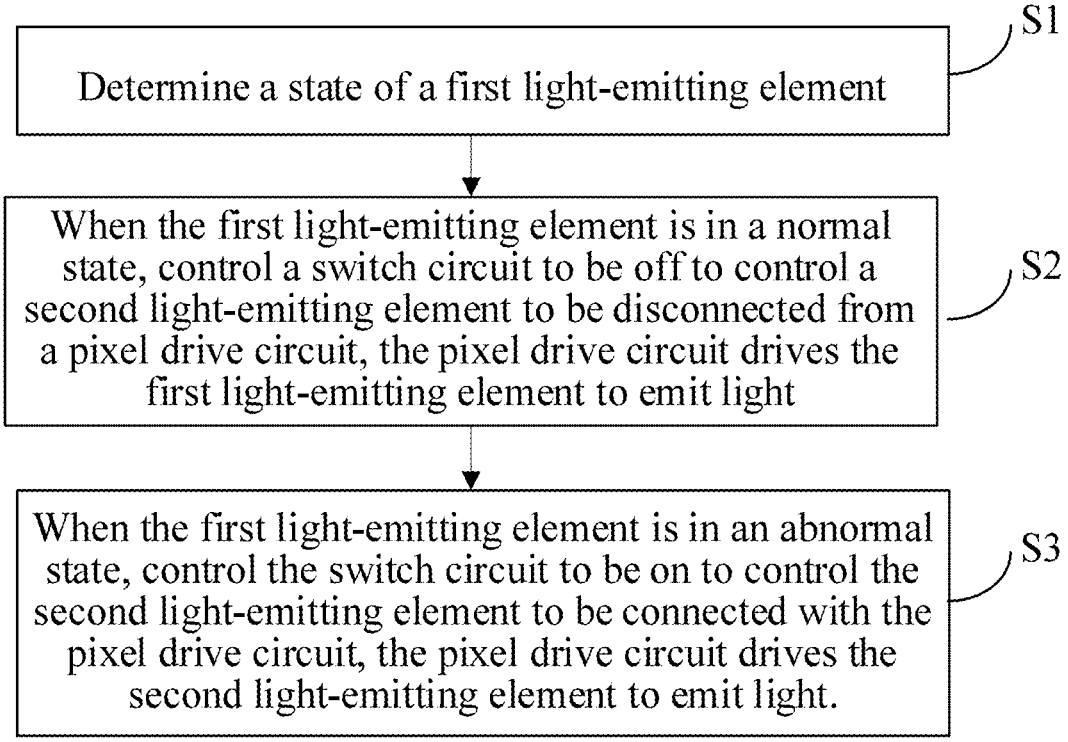
FIG. 10 is a schematic flowchart of a control method of a pixel circuit according to an embodiment of the present disclosure.

FIG. 10 is a schematic flowchart of a control method of a pixel circuit according to an embodiment of the present disclosure. As shown in FIG. 10, the control method of the pixel circuit according to the embodiment of the present disclosure includes the following acts S1 to S3.

S1, a state of a first light-emitting element is determined.

S2, when the first light-emitting element is in a normal state, a switch circuit is controlled to be off to control a second light-emitting element to be disconnected from a pixel drive circuit, wherein the pixel drive circuit drives the first light-emitting element to emit light.

S3, when the first light-emitting element is in an abnormal state, the switch circuit is controlled to be on to control the second light-emitting element to be connected with the pixel drive circuit, wherein the pixel drive circuit drives the second light-emitting element to emit light.

According to an embodiment of the present disclosure, controlling the switch circuit to be on or off includes that the control circuit writes, under a control of a first control terminal, a signal of a first data terminal to a control terminal of the switch circuit to control the switch circuit to be on or off.

To sum up, according to the control method of the pixel circuit proposed by the embodiment of the present disclosure, when the first light-emitting element is determined in a normal state, the switch circuit is controlled to be off to control the second light-emitting element to be disconnected from the pixel drive circuit, and the pixel drive circuit drives the first light-emitting element to emit light. When the first light-emitting element is in an abnormal state, the switch circuit is controlled to be on to control the second light-emitting element to be connected with the pixel drive circuit, and the pixel drive circuit drives the second light-emitting element to emit light. Therefore, according to the control method of the pixel circuit provided by the embodiment of the present disclosure, a light-emitting repair function can be achieved, and a yield of display panel can be improved by means of the switch circuit and the second light-emitting element, and a connection of the second light-emitting element and the first light-emitting element in parallel.

What we claim is:

1. A pixel circuit, comprising:

a first light-emitting element;

a pixel drive circuit, connected with the first light-emitting element;

a repair branch circuit, connected with a node between the pixel drive circuit and the first light-emitting element, wherein the repair branch circuit comprises a switch circuit and a second light-emitting element connected in series, and the switch circuit controls a connection or disconnection of the second light-emitting element with the pixel drive circuit; and a control circuit, connected with a control terminal of the switch circuit, a first data terminal and a first control terminal, wherein the control circuit is configured to write a signal of the first data terminal to the control terminal of the switch circuit under a control of the first control terminal to control on or off of the switch circuit, wherein the control circuit comprises:

a second transistor, wherein a first electrode of the second transistor is connected with the first data terminal, a second electrode of the second transistor is connected with the control terminal of the switch circuit, and a gate electrode of the second transistor is connected with the first control terminal.

2. The pixel circuit according to claim 1, wherein the control circuit comprises:

a first transistor, wherein a first electrode of the first transistor is connected with the node between the pixel drive circuit and the first light-emitting element, a second electrode of the first transistor is connected with the second light-emitting element, and a gate electrode of the first transistor is connected with the control circuit.

3. The pixel circuit according to claim 1, wherein the control circuit further comprises:

a first capacitor, wherein one terminal of the first capacitor is connected with both of the second electrode of the second transistor and the control terminal of the switch circuit, and the other terminal of the first capacitor is connected with a preset power supply.

4. The pixel circuit according to claim 1, wherein both of the first light-emitting element and the second light-emitting element are light-emitting diodes.

5. The pixel circuit according to claim 1, wherein the pixel drive circuit comprises:

a drive transistor, wherein a first electrode of the drive transistor is connected with a preset power supply, and a second electrode of the drive transistor is connected with the first light-emitting element and the repair branch circuit;

a third transistor, wherein a first electrode of the third transistor is connected with a second data terminal, a second electrode of the third transistor is connected with a gate of the drive transistor, and a gate electrode of the third transistor is connected with the first control terminal; and a second capacitor, wherein one terminal of the second capacitor is connected with the gate of the drive transistor, and the other terminal of the second capacitor is connected with the first electrode of the drive transistor.

6. The pixel circuit according to claim 5, wherein the pixel drive circuit further comprises:

a fourth transistor, wherein a first electrode of the fourth transistor is connected with an initialization terminal, a second electrode of the fourth transistor is connected with the gate of the drive transistor, and a gate electrode of the fourth transistor is connected with a reset terminal;

a fifth transistor, wherein a first electrode of the fifth transistor is connected with the initialization terminal, a second electrode of the fifth transistor is connected with the first light-emitting element, and a gate electrode the fifth transistor is connected with the reset terminal;

a sixth transistor, wherein a first electrode of the sixth transistor is connected with the gate of the drive transistor, a second electrode of the sixth transistor is connected with the second electrode of the drive transistor, and a gate electrode of the sixth transistor is connected with the first control terminal;

a seventh transistor, wherein the seventh transistor is located between and connected with the first electrode of the drive transistor and the preset power supply, and the gate electrode of the seventh transistor is connected with a second control terminal; and an eighth transistor, wherein the eighth transistor is located between and connected with the second electrode of the drive transistor and the first light-emitting element, a gate electrode of the eighth transistor is connected with the second control terminal.

7. A control method for a pixel circuit, wherein the pixel circuit comprises:

a first light-emitting element;

a pixel drive circuit, connected with the first light-emitting element;

a repair branch circuit, connected with a node between the pixel drive circuit and the first light-emitting element, wherein the repair branch circuit comprises a switch circuit and a second light-emitting element connected in series, and the switch circuit controls a connection or disconnection of the second light-emitting element with the pixel drive circuit; and a control circuit, connected with a control terminal of the switch circuit, a first data terminal and a first control terminal, wherein the control circuit is configured to write a signal of the first data terminal to the control terminal of the switch circuit under a control of the first control terminal to control on or off of the switch circuit, wherein the control circuit comprises:

a second transistor, wherein a first electrode of the second transistor is connected with the first data terminal, a second electrode of the second transistor is connected with the control terminal of the switch circuit, and a gate electrode of the second transistor is connected with the first control terminal, wherein the control method comprises:

determining a state of the first light-emitting element;

when the first light-emitting element is in a normal state, controlling the switch circuit to be off to control the second light-emitting element to be disconnected from the pixel drive circuit, wherein the pixel drive circuit drives the first light-emitting element to emit light; and when the first light-emitting element is in an abnormal state, controlling the switch circuit to be on to control the second light-emitting element to be connected with the pixel drive circuit, wherein the pixel drive circuit drives the second light-emitting element to emit light.

8. The control method of for the pixel circuit according to claim 7, wherein controlling the switch circuit to be on or off comprises:

under the control of the first control terminal, writing, by the control circuit, the signal of the first data terminal to the control terminal of the switch circuit to control on or off of the switch circuit.

* * * * *